United States Patent [19]

Brown et al.

[11] Patent Number: 4,558,471

[45] Date of Patent: Dec. 17, 1985

[54] PASSIVE DOSING DISPENSER FEATURING HIGH STRENGTH INITIAL CLEANING ACTION

[75] Inventors: Bruce Brown; Wilbur C. Strickland, Jr., both of Cincinnati, Ohio

[73] Assignee: The Procter & Gamble Company, Cincinnati, Ohio

[21] Appl. No.: 632,779

[22] Filed: Jul. 20, 1984

[51] Int. Cl.[4] ..... E03D 9/02

[52] U.S. Cl. ..... 4/228

[58] Field of Search ..... 4/228, 227, 229–233, 4/223–226; 222/416

[56] References Cited

U.S. PATENT DOCUMENTS

| | | | |
|---|---|---|---|
| 650,161 | 5/1900 | Williams et al. . | |
| 1,175,032 | 3/1916 | Williams . | |
| 1,623,132 | 4/1927 | Pennell et al. | 4/309 |
| 2,807,807 | 10/1957 | Harper | 4/228 |
| 3,121,236 | 2/1964 | Yardo et al. | 4/228 |
| 3,289,887 | 12/1966 | Farrar et al. | 222/1 |
| 3,423,182 | 1/1969 | Klasky | 23/267 |
| 3,504,384 | 4/1970 | Radley et al. | 4/228 |
| 4,171,546 | 10/1979 | Dirksing | 4/228 |
| 4,186,856 | 2/1980 | Dirksing | 222/424.5 |
| B 4,208,747 | 8/1983 | Dirksing | 4/228 |
| 4,216,027 | 8/1980 | Wages | 134/36 |
| 4,251,012 | 2/1981 | Owens et al. | 222/185 |
| 4,281,421 | 8/1981 | Nyquist et al. | 4/228 |
| 4,305,162 | 12/1981 | Cornelisse et al. | 4/228 |
| 4,307,474 | 12/1981 | Choy | 4/228 |
| 4,308,625 | 1/1982 | Kitko | 4/228 |
| 4,353,866 | 10/1982 | Wong | 4/228 X |
| 4,419,771 | 12/1983 | Richards | 4/228 |
| 4,438,534 | 3/1984 | Keyes et al. | 4/227 |
| 4,513,459 | 4/1985 | Doughty | 4/228 |

*Primary Examiner*—Stephen Marcus
*Assistant Examiner*—Leo James Peters
*Attorney, Agent, or Firm*—Richard C. Witte; John V. Gorman; Ronald J. Snyder

[57] ABSTRACT

A dispenser for cleaning and maintaining the cleanliness of a toilet bowl of a flush toilet is provided to co-dispense doses of two or more chemical solutions in response to the change in water level in the toilet tank reservoir during a flush cycle. The dispenser is to have an operational life based on an approximately predetermined number of flush cycles and includes a first internal reservoir containing a quantity of soluble solid-state first chemical sufficient to provide a saturated dose of first chemical cleaning solution in response to each flush cycle throughout the operational life of the dispenser to thereby maintain bowl cleanliness. A second internal reservoir is also provided which contains a quantity of soluble solid-state second chemical sufficient to provide a saturated dose of second chemical cleaning solution in response to each flush cycle only during an initial minor portion of the operational life of the dispenser thereby providing additional concentration of chemicals within the toilet bowl to facilitate loosening of established organic soil deposits on contacting toilet bowl surfaces. Both the first and second internal reservoirs include dispensing passageways for conveying the respective doses of chemical solutions to the water in the toilet tank in response to water level change therewithin during a flush cycle. Both reservoirs also include air vents and means to provide isolation of the respective chemical solutions from the toilet tank reservoir water during quiescent periods.

16 Claims, 2 Drawing Figures

PASSIVE DOSING DISPENSER FEATURING HIGH STRENGTH INITIAL CLEANING ACTION

TECHNICAL FIELD

This invention relates to a dispenser for cleaning and maintaining the cleanliness of a toilet bowl of a flush toilet, and, more particularly, to a dispenser which features high strength cleaning action during an initial minor portion of the dispenser's operational life, and lower strength cleaning action for the balance thereof.

BACKGROUND ART

Passive dosing dispensers featuring a wide variety of structures and operations are relatively abundant in the prior art. U.S. Pat. No. 4,208,747, which issued to Robert Dirksing on June 24, 1980 (re-examination certificate issued Aug. 16, 1983), discloses a passive dispensing unit for dosing chemical solutions to toilet tank water during a flush cycle, and which utilizes air locks to isolate its chemical solutions from the toilet tank water during quiescent periods. The chemical solutions of the Dirksing reference are dispensed in response to toilet water level changes during a flush cycle.

The prior art also includes dispensing units designed to remove built-up soil deposits in toilets via automatic chemical dispensing devices. U.S. Pat. No. 3,121,236, which issued to F. G. Yadro et al. on Feb. 18, 1964, teaches the metering of chemical compounds into each tankful of water in a flush tank in amounts sufficient to stop further build-up of deposits and to gradually remove pre-existing deposits. The Yadro dispenser comprises an open-ended box having inlet/discharge holes formed in the side walls of the box and containing a block of soluble chemical therewithin. Tank water enters the dispenser as the water level rises at the end of a flush cycle dissolving some of the chemical block to form a solution which is discharged during the next flushing cycle.

Another automatic toilet bowl dispenser is disclosed in U.S. Pat. No. 2,807,807, which issued to R. H. Harper on Oct. 1, 1957. The Harper dispenser includes a flexible bag filled with soluble, solid chemical particles and having a plurality of apertures arranged in a vertically spaced relationship in the bag. The Harper reference alleges that during the first several flush cycles, soluble chemical above the level of the apertures is dissolved to form a relatively concentrated chemical solution with the water in the tank. After the solid particles are dissolved to a level below the apertures, only the top layer of solid particles will be available to form a solution with water entering the bag, thus lowering the amount of solid chemical entering into solution during flush cycles thereafter. The Harper dispenser thereby allegedly provides a high initial concentration of chemicals during the first several flush cycles in the dispenser's operational life, and a lower concentration thereafter. It is believed, however, that the Harper dispenser would actually deliver lower level doses of chemical during the initial flushing cycles, with such levels increasing as more sudden volume could be contained in and dispensed from the flexible bag. The Harper dispenser would thereby fail to provide high initial dosage levels, and lower subsequent dosage levels.

Despite all of the prior work done in this area, as evidenced by the above-cited patents, there remain problems in accurately dispensing high strength doses of chemicals to a toilet bowl during an initial period, and following such initial period dispensing a lesser concentration of chemicals. An economic device was needed to dispense such high strength initial doses of chemical solutions during an initial number of flush cycles, while isolating such chemical solutions from the toilet tank water during quiescent periods between flushes.

DISCLOSURE OF THE INVENTION

It is an object of this invention to obviate the abovedescribed problems.

It is another object of the present invention to provide a dispenser for cleaning and maintaining the cleanliness of a toilet bowl which can deliver high strength dosages of chemical solutions during each of an initial number of flush cycles, and lower strength maintenance levels of chemical solutions during each flush cycle thereafter.

In accordance with one aspect of the present invention, there is provided a dispenser for cleaning and maintaining the cleanliness of a toilet bowl of a flush toilet equipped with a toilet tank reservoir, and adapted to be located in such toilet tank reservoir and to co-dispense doses of two or more chemical solutions in response to the change in water level in the toilet tank reservoir during a flush cycle. The dispenser has an operational life based on an approximately predetermined number of flush cycles and includes a first internal reservoir for containing a quantity of first chemical cleaning solution. The first reservoir contains a quantity of soluble solid-state first chemical sufficient to provide a saturated dose of first chemical cleaning solution in response to each flush cycle throughout the operational life of the dispenser, thereby maintaining bowl cleanliness. The first internal reservoir also includes a first liquid dispensing passageway in fluid communication with the first reservoir for conveying the dose of first chemical solution to the water in the toilet tank in response to the water level change during each flush cycle. The first internal reservoir is also in fluid communication with a first air vent, and both the first dispensing passageway and first air vent include means for providing isolation of the first chemical solution from the toilet tank reservoir water during quiescent periods between flushes. A second internal reservoir is provided to contain a quantity of second chemical cleaning solution and to contain a quantity of soluble, solid-state second chemical sufficient to provide a saturated dose of second chemical cleaning solution in response to each flush cycle only during an initial minor portion of the operational life of the dispenser. The dose of second chemical cleaning solution provides additional concentration of chemicals within the toilet bowl to facilitate loosening of established organic soil deposits on contacting toilet bowl surfaces. The second reservoir further includes a second dispensing passageway in fluid communication therewith for conveying the dose of second chemical solution to the water in the toilet tank reservoir in response to the water level change during each flush cycle of the initial portion of the dispenser's operational life. A second air vent is in fluid communication with the second reservoir, and both the second dispensing passageway and the second air vent include means for providing isolation of the second chemical solution from the toilet tank reservoir water during quiescent periods.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

Referring now to the drawings and detail, wherein like numerals indicate the same elements throughout the views, a passive dosing dispenser 20 of the present invention is shown. Dispenser 20 can be produced from two thin thermoformed plastic halves (e.g. one-half thermoformed and one-half planar) having product tablets inserted into the proper compartments, and which are sealed together by any conventional means, such as heat sealing, radiation sealing, or adhesive sealing. Such plastic halves are most preferably sealed together along generally flat lands, as indicated by the number 22 in the drawing figures. The passageways and reservoirs (or compartments) of dispenser 20 can be produced with differing depths in order to provide the desired volume for each passageway or reservoir. Briefly, referring to FIGS. 1 and 2, a dispenser 20 containing solid, water soluble products 21*a*, 21*b*, and 21*c*, is disposed, for instance, in a toilet tank (not shown) on a bracket or other mounting means 35 so that the FULL level of water 63 in the toilet tank reaches an approximate level as shown at A in FIG. 1. FIG. 2 shows dispenser 20 at a point in a flush cycle where water 63 is completely below dispenser 20. This lower water level is indicated at B of FIG. 2. Mounting means 35 is illustrated in the figures as a bayonet member portion of a bracket which is slidably adjustable within a substantially rectangular sleeve or channel 30.

Figure 1:
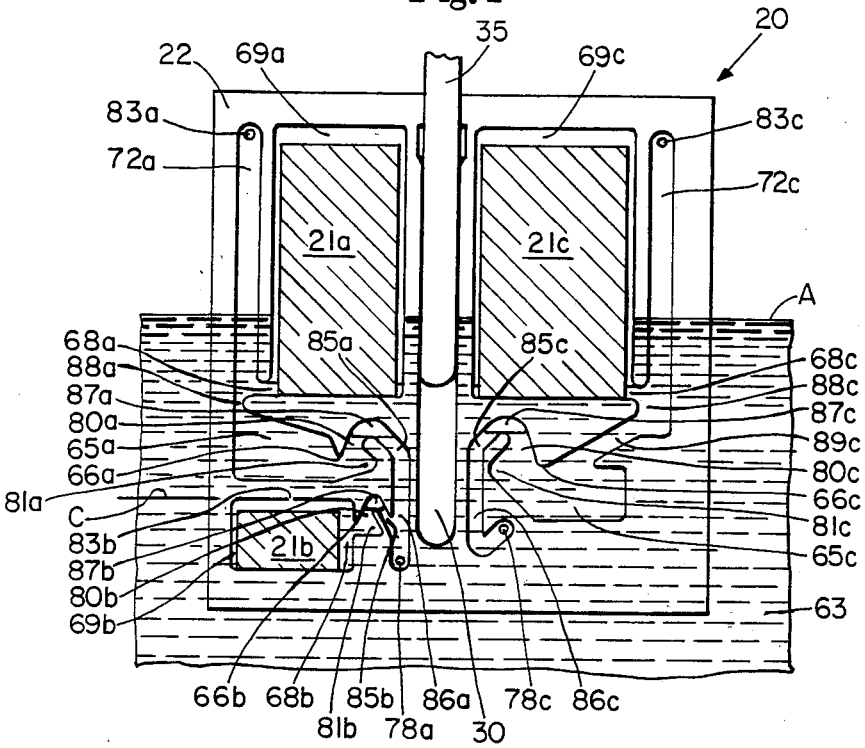
FIG. 1 is a vertical cross-sectional view of a passive dosing dispenser which is an embodiment of the present invention, the dispenser shown as mounted within a toilet tank reservoir (not shown) and illustrating the high water level or quiescent period of a flush cycle.
Figure 2:
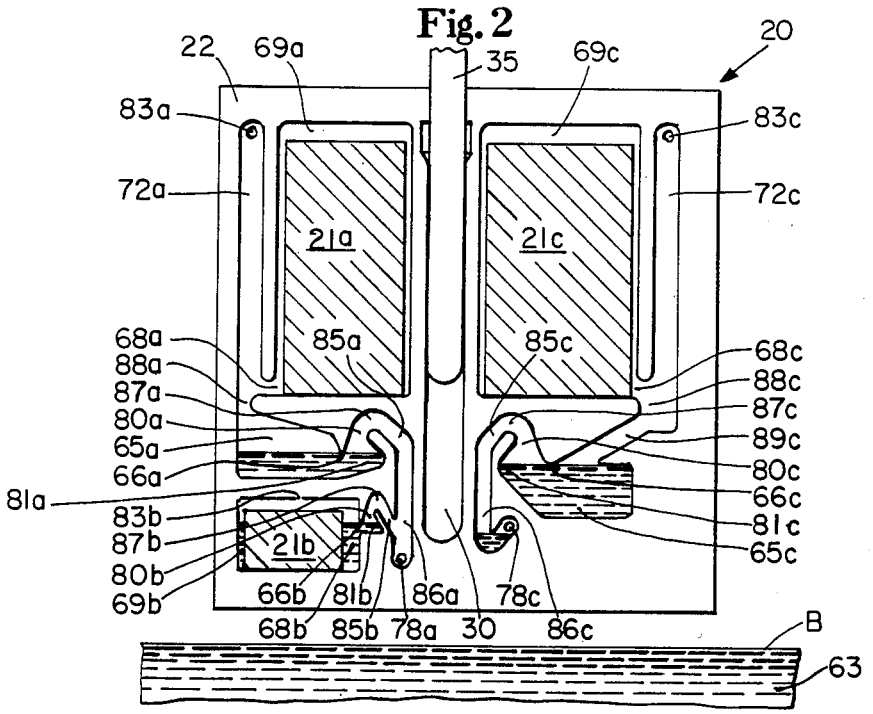
FIG. 2 is a vertical cross-sectional view of the dosing dispenser of FIG. 1 illustrating a point in a flush cycle wherein the water level is below such dispenser.

A first internal reservoir 69*a* is illustrated as including a first solid water-soluble chemical product 21*a* and secondary product reservoir 68*a*, and having vertical passageway 88*a* connecting the secondary product reservoir 68*a* to primary product reservoir 65*a*. Inlet/discharge conduit 80*a* connects reservoir 65*a* to horizontal passageway 87*a* (preferably a generally inverted U-shaped section), which in turn connects to the uppermost vertical passageway 85*a* and vertical passageway 86*a* therebelow. Inlet/discharge conduit 80*a* also includes air trap 81*a*, which will be discussed in greater detail below. Vertical passageway 86*a* leads directly to inlet/discharge port 78*a*. The described discharge passageway system (i.e. vertical passageway 88*a*, primary product reservoir 65*a*, inlet/discharge conduit 80*a*, horizontal passageway 87*a*, vertical passageways 85*a* and 86*a*, and inlet/discharge port 78*a*) provides potential fluid communication between first internal reservoir 69*a* and the toilet tank water 63 within which dispenser 20 is to be located. Also in fluid communication with first internal reservoir 69*a* is air vent passageway 72*a* and air vent 83*a*. The structure and function of the first internal reservoir 69*a*, as well as its discharge passageway system and air venting system, are substantially the same as the corresponding dispenser described in commonly assigned U.S. Pat. No. 4,208,747, which issued to Robert S. Dirksing on June 24, 1980 (reexamination certificate issued Aug. 16, 1983), entitled Passive Dosing Dispenser Employing Trapped Air Bubble to Provide Air-Lock, the disclosure of said patent being incorporated herein by reference.

A third internal reservoir 69*c* containing a water soluble, solid-state third chemical product 21*c* is illustrated as having an inlet/discharge passageway system and air vent system substantially similar to that described above with regard to the first internal reservoir 69*a*. The primary product reservoir 65*c* of third internal reservoir 69*c* is illustrated as being of slightly different shape and size relative to the corresponding primary product reservoir 65*a* of first internal reservoir 69*a*. Exact dimensions of the various reservoirs, passageways, etc. are not critical to the subject invention and can be modified in accordance with the teachings herein and in the referenced Dirksing '747 patent, as appropriate, to deliver desired doses of chemical solutions in response to water level changes during flushing cycles.

Corresponding to the structure as described with respect to first internal reservoir 21*a*, third internal reservoir 69*c* comprises a secondary product reservoir 68*c* and a vertical passageway 88*c*. Vertical passageway 88*c*, however, is connected to a primary product reservoir 65*c* by means of a connecting passageway 89*c*, unlike the structure described with regard to first internal reservoir 69*a*. Connecting passageway 89*c* is utilized to facilitate proper positioning of primary product reservoir 65*c* relative to the inlet/discharge passageway system connecting primary product reservoir 65*c* and inlet/discharge port 78*c*. Inlet/discharge conduit 80*c* includes air trap 81*c* disposed adjacent thereto, with inlet/discharge conduit 80*c* being connected to horizontal passageway 87*c*. Horizontal passageway 87*c* is in turn connected to the uppermost vertical passageway 85*c* and vertical passageway 86*c*. Vertical passageway 86*c* extends downwardly and bends upwardly at its distal end terminating at inlet/discharge port 78*c*. Inlet/discharge port 78*c* is preferably faces away from inlet/discharge port 78*a* in applications in which it is desirable to avoid premature reaction between chemical solutions discharged therefrom. Often it is preferable to avoid immediate reaction between concentrated reactive chemical cleaning solutions in the toilet tank in order to allow adequate dilution of the reactants prior to reaction, and to delay such chemical reaction until such solutions are within the toilet bowl where cleaning action is most desired.

A second internal reservoir 69*b* is located near the lower portion of dispenser 20 below first internal reservoir 69*a*, and has its inlet/discharge system connected to vertical passageway 86*a*. Second internal reservoir 69*b* contains a quantity of soluble, solid-state second chemical product 21*b*. The quantity of second chemical product 21*b* is designed to be sufficient to provide a saturated dose of second chemical cleaning solution in response to each flush cycle only during an initial minor portion of the operational life of dispenser 20. Therefore, unlike first chemical 21*a*, second chemical 21*b* shall be dispensed only during an initial number of flush cycles in the overall life of dispenser 20. The chemical solution provided by second reservoir 69*b* provides additional concentration of chemicals within the toilet bowl to facilitate the loosening of established organic soil deposits on contacting toilet bowl surfaces. By providing such additional concentration of chemicals during such initial flush cycles in the operational life of dispenser 20, a dispenser of the current invention can remove built-up organic soil deposits on the toilet bowl surfaces thereby helping to obviate a need for manual scrubbing by the consumer.

Second internal reservoir 69*b* also includes an inlet/-discharge passageway system very similar to those described above with regard to the first and third internal reservoirs 69*a* and 69*c*, respectively. However, reservoir 69*b* has a combined primary and secondary product reservoir 68*b*. The combination of such primary and secondary product reservoirs is not essential, but is preferred to minimize space requirements of the overall dispenser 20. Inlet/discharge conduit 80*b* has an air trap 81*b* formed therein and is connected to horizontal passageway 87*b*, which in turn is connected to the downward sloping passagway 85*b*. Passageway 85*b* is connected at its lower end to vertical passageway 86*a*, thereby enabling placement of second internal reservoir 69*b* in fluid communication with inlet/discharge port 78*a*. It has been found that by connecting the inlet/discharge passageway system of second internal reservoir 69*b* to passageway 86*a*, the space requirements for the necessary inlet/discharge passageway system of such a second internal reservoir can be minimized, thereby conserving dispenser size and cost.

Air vent 83*b* is shown as being formed in the top of second internal reservoir 69*b*, however, any manner of providing a vent therein can be utilized. For example, vent 83*b* could be connected directly to air vent passageway 72*a*. Alternatively, second reservoir 69*b* could be formed with its own air vent passageway and air inlet/discharge port similar to 72*a* and *c*, and 83*a* and *c*, as described above.

As described with regard to the first and third internal reservoirs 69*a* and 69*c*, second internal reservoir 69*b* is designed to dispense a saturated dose of second chemical cleaning solution in response to water level changes during flush cycles as substantially described in the referenced Dirksing '747 patent; however, such second solution shall cease being dispensed after an approximately predetermined minor number of flush cycles during the initial portion of the dispenser's operational life. While the number of flush cycles constituting such minor initial portion of the operational life will vary depending on factors such as the chemicals being dispensed, the desired operational life of the dispenser, soils to be removed, and environmental factors such as temperature; it is most preferred that such minor number be less than one-half the operational life of the dispenser.

In use, dispenser 20 is located in the toilet tank reservoir of a flush toilet on a bracket 35 or other mounting means (not shown) so that the FULL level A of water 63 in the toilet tank submerges a portion of dispenser 20, as shown in FIG. 1. As described in the referenced Dirksing '747 patent, as the toilet tank water 63 rises to its FULL position A, water enters dispenser 20 through inlet/discharge ports 78*a* and 78*c*, respectively. The entering tank water 63 begins to collect in the primary product reservoirs 65*a*, 68*b* and 65*c*, respectively, and air is trapped in the respective air traps 81*a*, 81*b* and 81*c*. Such air bubbles are retained within the confines of air traps 81*a*, 81*b* and 81*c* until toilet tank water 63 ceases to enter each of the reservoirs of dispenser 20, at which time the retained air bubble in the associated air trap migrates or repositions itself into the upper portions of each of horizontal passageways 87*a*, 87*b*, and 87*c*, respectively, thereby forming air locks which isolate the water on the inside of horizontal passageways 87*a*, 87*b* and 87*c*, from water within passageways 85*a*, 86*a*, 85*b*, 85*c*, 86*c*, and the balance of the water in the toilet tank. It is important that means be included in dispenser 20 to provide such isolation to better control the dispensing and concentration of chemical solutions within the toilet tank and bowl.

Air vent 83*b* is preferably formed as simply a hole in the upper portion of second reservoir 69*b*, with such hole preferably being approximately 1.6 mm (1/16 inch) or less in diameter. It has been found that an air vent of such small dimension is sufficient to adequately vent second reservoir 69*b* during dispensing operations, and small enough to hold a small amount of air within the reservoir during refill of dispenser 20 at the end of a flush cycle, thereby providing air lock isolation of the solution within second reservoir 69*b* from the tank water 63 during quiescent periods. The hole or vent 83*b* must be small enough that surface tension holds the air within reservoir 69*b* when tank water 63 rises above the level of vent 83*b*. Vents 83*b* and 83*c* preferably remain above the FULL water level A at all times, and air within vent passageways 72*a* and 72*c* isolates tank water 63 from solution within air vent passageways 72*a* and 72*c*.

During a flush cycle, the water level within the toilet tank will fall. Upon the lowering of the level of water 63, first and third chemical solutions begin to flow from the primary product reservoirs 65*a* and 65*c*, respectively, through passageways 86*a* and 86*c* and out inlet/-discharge ports 78*a* and 78*c*. Such flow of solutions continues until the level of solutions within primary product reservoirs 65*a* and 65*c*, respectively, falls below the baffle tips 66*a* and 66*c*. As an example, when the level of solution within reservoir 65*a* falls below baffle tip 66*a*, air flows in through vent passageway 72*a*, through passageway 88*a* and the upper portion of reservoir 65*a*, into inlet/discharge conduit 80*a* and the flow of first solution substantially ceases. Similarly, flow of second chemical solution shall cease when the level of solution within reservoir 65*c* drops below baffle tip 66*c*.

The discharge of first solution through passageway 86*a* will, in turn, facilitate discharge of product solution from product reservoir 68*b* of second internal reservoir 69*b*. It has been found that because the pressure differential which is needed to dispense such second chemical solution from reservoir 69*b* is not adequately established until the water level in the toilet tank drops below vent 83*b* (level C as shown in FIG. 1) and the first solution has begun to be dispensed through passageway 86*a*, the second chemical cleaning solution drawn from reservoir 69*b* is dispensed at a time slightly later in the flush cycle than the solutions from either first internal reservoir 69*a* or third internal reservoir 69*c*. It has also been found that this slight dispensing delay can be useful to promote more efficient use of the second chemical solution, as more of such second solution remains in the toilet bowl at the end of the flush cycle. Dispensing from second reservoir 69*b* will continue until the level of solution therewithin falls below baffle tip 66*b*, at which time air begins to flow through vent 83*b* and into inlet/discharge conduit 80*b*, and flow of second solution substantially ceases. Thus, the unique structure of the subject invention not only permits the dispensing of additional treating solution doses for the limited initial number of flushes, but also provides efficacious benefits as a result of its dose timing, and further provides these benefits while minimizing additional dispenser size and cost required.

It should be understood that second internal reservoir 69b need not be connected to passageway 86a of the first internal reservoir, and could feature its own vertical passageway and inlet/discharge port. Such an independent second internal reservoir could equally help provide the desired initial high concentration of chemicals within the toilet bowl during a predetermined minor portion of the operational life of the dispenser, and could further be designed to delay its dosing until late in the flush cycle by various baffles or other means known to those knowledgeable in the industry. For economy and efficiency, however, it is preferred that the first and second internal reservoirs have a common inlet/discharge port as described above.

It should also be noted that a dispenser could be made in accordance with this invention without including a third internal reservoir 69c. A dispenser with only a first and second internal reservoir, as shown in the left half of FIG. 1, might be desired where only a single chemical or a single mixture of compatible chemicals need be added to the water, with high levels of such chemical or mixture of chemicals desired during an initial minor portion of the dispenser's operational life. It is, however, preferred to utilize the three internal reservoirs, as described, in applications where two or more reactive chemicals are to be dispensed.

The number of flush cycles constituting the initial minor portion of the dispenser's operational life in which high strength concentration dosing is desired can be approximately predetermined by design of second internal reservoir 69b, taking into account such variables as concentration of chemicals desired, solubility and other physical characteristics of the chemicals to be dispensed, and specific soils to be removed from the bowl surface. In a particularly preferred embodiment, dispenser 20 of the present invention would contain: (a) sufficient quantity of first chemical product to deliver an aqueous solution which produces hypochlorite ions and provides between about 3 ppm and about 15 ppm of available chlorine in the toilet bowl for in the range of about 100 to 500 flushing cycles (the number of such cycles for which the dispenser is designed being the approximately predetermined minimum operational life of dispenser 20); (b) sufficient quantity of third chemical product to deliver from about 0.1 ppm to about 20 ppm bromide ion in aqueous solution in the toilet bowl for at least the initial approximately 15 to 70 flushing cycles (preferably less than half the operational life) during the operational life of dispenser 20; and (c) sufficient quantity of second chemical product to deliver additional hypochlorite ions in aqueous solution such that there is between about 20 ppm and about 100 ppm of available chlorine in the toilet bowl for approximately the initial 15 to 70 flushing cycles during the operational life of dispenser 20. Such first and second chemical products can be any compound which provides hypochlorite ions ($OCl^-$) in aqueous solution. Such compounds include alkali metal and alkaline earth metal hypochlorites. The third chemical product can be any water-soluble source of bromide ions such as water-soluble inorganic salts (e.g. sodium and potassium bromides, calcium and magnesium bromides, zinc bromide or ferric bromide).

Hypochlorite has been found to be an effective sanitizing agent for cleansing toilet bowls. It has also been found that the bromide ions react with hypochlorite ions in aqueous solution thereby augmenting and accelerating the cleaning action of the hypochlorite ions within the toilet bowl. Incorporation of such chemicals within the dispenser described herein is, therefore, particularly preferred for providing effective high strength initial cleaning action followed by lower strength maintenance cleaning action during the balance of the operational life of such dispenser. The dimensions of the internal reservoirs are designed to contain the required quantity of water soluble solid chemical products and the required volume of chemical cleaning solution in order to attain such desired concentrations for such desired number of flushing cycles. Concentrations desired for particular applications may vary depending upon specific chemicals used.

Various additional modifications of the described invention will be apparent to those skilled in the art. Accordingly, the scope of the present invention should be considered in terms of the following claims and is understood not to be limited to the details of structure and operation described and shown in the specification and drawings.

We claim:

1. A dispenser for cleaning and maintaining the cleanliness of a toilet bowl of a flush toilet equipped with a toilet tank reservoir, said dispenser being adapted to be located in the toilet tank reservoir and to co-dispense doses of two or more chemical solutions in response to the change in water level in said toilet tank reservoir during a flush cycle, said dispenser having an operational life based on an approximately predetermined number of flush cycles and comprising:

(a) a first internal reservoir for containing a quantity of first chemical cleaning solution, said first reservoir containing a quantity of a soluble, solid-state first chemical sufficient to provide a saturated dose of first chemical cleaning solution in response to each flush cycle throughout said operational life to thereby maintain bowl cleanliness, and further comprising a first liquid dispensing passageway in fluid communication with said first reservoir for conveying said dose of first chemical solution to the water in said toilet tank reservoir in response to said change in water level during each flush cycle, and a first air vent in fluid communication with said first reservoir, both said first dispensing passageway and said first air vent including passive means for providing isolation of said first chemical solution from said toilet tank reservoir water during quiescent periods between flushes; and (b) a second internal reservoir for containing a quantity of second chemical cleaning solution, said second reservoir containing a quantity of soluble, solid-state second chemical sufficient to provide a saturated dose of second chemical cleaning solution in response to each flush cycle during at least a portion of said operational life of said dispenser, thereby providing additional concentration of chemicals within said bowl to facilitate the loosening of established organic soil deposits on contacting toilet bowl surfaces, and said second reservoir further comprising a second liquid dispensing passageway in fluid communication with said second reservoir for conveying said dose of second chemical solution to the water in said toilet tank reservoir in response to said change in water level during each flush cycle throughout said portion of said operational life, and a second air vent in fluid communication with said second reservoir, both said second dispensing passageway and said second air vent including passive means for providing isolation of said second chemical solution from said toilet tank reservoir water during quiescent periods, and said second dispensing passageway being connected at its lower end to the lower portion of said first dispensing passageway and thereby having a common dispensing outlet therewith such that first chemical solution discharged through said first liquid dispensing passageway facilitates discharge of said second chemical solution through said second liquid dispensing passageway.

2. The dispenser of claim 1, wherein said first and second chemicals include hypochlorite sanitizing agents.

3. The dispenser of claim 2 further comprising a third internal reservoir having an internal reservoir, a liquid dispensing passageway, an air vent, and means for providing isolation similar to the corresponding structure of said first internal reservoir and containing a quantity of a soluble, solid-state third chemical sufficient to provide a saturated dose of third chemical solution in response to each flush cycle at least during a portion of said operational life.

4. The dispenser of claim 3 wherein said third chemical solution provides bromide ions which react with said hypochlorite sanitizing agents in aqueous solution thereby accelerating the cleaning action of said sanitizing agents within said toilet bowl at least during a portion of said operational life.

5. The dispenser of claim 1, wherein said horizontal portion of said second dispensing passageway is located on said dispenser below said horizontal portion of said first dispensing passageway.

6. A dispenser for cleaning and maintaining the cleanliness of a toilet bowl of a flush toilet equipped with a toilet tank reservoir, said dispenser being adapted to be located in the toilet tank reservoir and to co-dispense doses of two or more chemical solutions in response to the change in water level in said toilet tank reservoir during a flush cycle, said dispenser having an operational life based on an approximately predetermined number of flush cycles and comprising:

(a) a first internal reservoir for containing a quantity of first chemical cleaning solution, said first reservoir containing a quantity of a soluble, solid-state first chemical sufficient to provide a saturated dose of first chemical cleaning solution in response to each flush cycle throughout said operational life to thereby maintain bowl cleanliness, and further comprising a first liquid dispensing passageway in fluid communication with said first reservoir for conveying said dose of first chemical solution to the water in said toilet tank reservoir in response to said change in water level during each flush cycle, and a first air vent in fluid communication with said first reservoir, both said first dispensing passageway and said first air vent including passive means for providing isolation of said first chemical solution from said toilet tank reservoir water during quiescent periods between flushes; and (b) a second internal reservoir for containing a quantity of second chemical cleaning solution, said second reservoir containing a quantity of soluble, solid-state second chemical sufficient to provide a saturated dose of second chemical cleaning solution in response to each flush cycle only during an initial minor portion of said operational life of said dispenser, thereby providing additional concentration of chemicals within said bowl to facilitate the loosening of established organic soil deposits on contacting toilet bowl surfaces, and said second reservoir further comprising a second liquid dispensing passageway in fluid communication with said second reservoir for conveying said dose of second chemical solution to the water in said toilet tank reservoir in response to said change in water level during each flush cycle throughout said initial portion of said operational life, and a second air vent in fluid communication with said second reservoir, both said second dispensing passageway and said second air vent including passive means for providing isolation of said second chemical solution from said toilet tank reservoir water during quiescent periods, and said second dispensing passageway being connected at its lower end to the lower portion of said first dispensing passageway and thereby having a common dispensing outlet with said first dispensing passageway such that first chemical solution discharged through said first liquid dispensing passageway facilitates discharge of said second chemical solution through said second liquid dispensing passageway.

7. The dispenser of claim 6, wherein said first dispensing passageway includes a vertical passageway leading to said dispensing outlet, and wherein said second dispensing passageway is connected at its lower end to said vertical passageway, whereby said dose of first chemical cleaning solution dispensed through said first dispensing passageway during a flush cycle helps establish a pressure differential within said second dispensing passageway to facilitate dispensing of said dose of second chemical cleaning solution.

8. The dispenser of claim 7, wherein said first and second chemicals include hypochlorite sanitizing agents.

9. The dispenser of claim 8 further comprising a third internal reservoir having an internal reservoir, a liquid dispensing passageway, an air vent, and means for providing isolation similar to the corresponding structure of said first internal reservoir and containing a quantity of a soluble, solid-state third chemical sufficient to provide a saturated dose of third chemical solution in response to each flush cycle at least during said initial minor portion of said operational life.

10. The dispenser of claim 9 wherein said third chemical solution provides bromide ions which react with said hypochlorite sanitizing agents in aqueous solution, thereby accelerating the cleaning action of said sanitizing agents within said toilet bowl at least during said initial minor portion of said operational life.

11. The dispenser of claims 6, 7, 8, 9 or 10, wherein said minor portion of said operational life is less than one-half said operational life.

12. A dispenser for cleaning and maintaining the cleanliness of a toilet bowl of a flush toilet equipped with a toilet tank reservoir, said dispenser being adapted to be located in the toilet tank reservoir and to co-dispense doses of two or more chemical solutions in response to the change in water level in said toilet tank reservoir during a flush cycle, said dispenser having an operational life based on an approximately predetermined number of flush cycles and comprising:

(a) a first internal reservoir for containing a quantity of first chemical cleaning solution, said first reservoir containing a quantity of a soluble, solid-state first chemical sufficient to provide a saturated dose of first chemical cleaning solution in response to each flush cycle throughout said operational life to thereby maintain bowl cleanliness, and further comprising a first liquid dispensing passageway in fluid communication with said first reservoir for conveying said dose of first chemical solution to the water in said toilet tank reservoir in response to said change in water level during each flush cycle, and a first air vent in fluid communication with said first reservoir, both said first dispensing passageway and said first air vent including passive means for providing isolation of said first chemical solution from said toilet tank reservoir water during quiescent periods between flushes, and said first dispensing passageway further comprising a horizontal portion and a downward sloping portion; and (b) a second internal reservoir for containing a quantity of second chemical cleaning solution, said second reservoir containing a quantity of soluble, solid-state second chemical sufficient to provide a saturated dose of second chemical cleaning solution in response to each flush cycle only during an initial minor portion of said operational life of said dispenser, thereby providing additional concentration of chemicals within said bowl to facilitate the loosening of established organic soil deposits on contacting toilet bowl surfaces, and said second reservoir further comprising a second liquid dispensing passageway in fluid communication with said second reservoir for conveying said dose of second chemical solution to the water in said toilet tank reservoir in response to said change in water level during each flush cycle throughout said initial portion of said operational life, and a second air vent in fluid communication with said second reservoir, both said second dispensing passageway and said second air vent including passive means for providing isolation of said second chemical solution from said toilet tank reservoir water during quiescent periods, said second dispensing passageway further comprising a horizontal portion and a downward sloping portion, said second dispensing passageway being connected at the lower end of its downward sloping portion to said downward sloping portion of said first dispensing passageway below said horizontal portion of said first dispensing passageway and thereby having a common dispensing outlet therewith such that first chemical solution discharged through said first liquid dispensing passageway facilitates discharge of said second chemical solution through said second liquid dispensing passageway.

13. The dispenser of claim 12, wherein said first and second chemicals include hypochlorite sanitizing agents.

14. The dispenser of claim 13 further comprising a third internal reservoir having an internal reservoir, a liquid dispensing passageway, an air vent, and means for providing isolation similar to the corresponding structure of said first internal reservoir and containing a quantity of a soluble, solid-state third chemical sufficient to provide a saturated dose of third chemical solution in response to each flush cycle at least during said initial minor portion of said operational life.

15. The dispenser of claim 14 wherein said third chemical solution provides bromide ions which react with said hypochlorite sanitizing agents in aqueous solution thereby accelerating the cleaning action of said sanitizing agents within said toilet bowl at least during said initial minor portion of said operational life.

16. The dispenser of claims 12, 13, 14 or 15, wherein said minor portion of said operational life is less than one-half said operational life.

* * * * *

UNITED STATES PATENT AND TRADEMARK OFFICE

CERTIFICATE OF CORRECTION

PATENT NO. : 4,558,471

DATED : 12/17/85

INVENTOR(S) : Bruce Brown and Wilbur C. Strickland, Jr.

It is certified that error appears in the above-identified patent and that said Letters Patent is hereby corrected as shown below:

Column 1, line 61, delete "sudden" and insert therefor -- solution -- .

Column 3, line 65, delete "the" and insert therefor -- this -- .

Column 5, line 17, delete "passagway" and insert therefor -- passageway -- .

Column 6, line 22, delete "83b" (second occurrence) and insert therefor -- 83a --.

Column 9, claim 5, line 32, delete "1" and insert therefor -- 16 -- .

Signed and Sealed this

*Sixteenth* Day of *September 1986*

[SEAL]

*Attest:*

DONALD J. QUIGG

*Attesting Officer*

*Commissioner of Patents and Trademarks*